US006328202B1

(12) United States Patent
Giblin

(10) Patent No.: US 6,328,202 B1
(45) Date of Patent: Dec. 11, 2001

(54) LINER AND CARTON

(75) Inventor: Edward John Giblin, Hopatcong, NJ (US)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/473,593

(22) Filed: Dec. 29, 1999

(51) Int. Cl.[7] ..... B65D 5/56
(52) U.S. Cl. ..... 229/122.32; 229/122.33
(58) Field of Search ..... 229/119, 122.32, 229/122.33; 220/FOR 120, 122

(56) References Cited

U.S. PATENT DOCUMENTS

| | | | | |
|---|---|---|---|---|
| 959,261 | * | 5/1910 | Reber | 229/122.32 |
| 2,606,709 | * | 8/1952 | Carey et al. | 229/122.32 |
| 3,891,137 | | 6/1975 | Ellison et al. . | |
| 4,017,016 | * | 4/1977 | Ivy | 229/122.33 |
| 4,380,314 | * | 4/1983 | Langston, Jr. et al. | 229/122.32 |
| 4,382,504 | | 5/1983 | Vesborg . | |
| 4,572,424 | * | 2/1986 | Muise et al. | 229/119 |
| 5,039,002 | | 8/1991 | Spamer . | |
| 5,277,360 | | 1/1994 | DeMott . | |
| 5,320,279 | | 6/1994 | Giblin et al. . | |
| 5,363,981 | | 11/1994 | Giblin et al. . | |
| 5,372,299 | | 12/1994 | Edgerton, Jr. et al. . | |
| 5,439,133 | * | 8/1995 | Stone | 229/122.32 |
| 5,487,504 | | 1/1996 | Baird . | |
| 5,657,872 | | 8/1997 | Leftwich et al. . | |
| 5,718,337 | | 2/1998 | Carr et al. . | |
| 5,775,576 | * | 7/1998 | Stone | 229/122.33 |
| 5,893,513 | * | 4/1999 | Stone et al. | 229/122.33 |
| 6,015,084 | * | 1/2000 | Mathieu et al. | 229/122.32 |

FOREIGN PATENT DOCUMENTS

01/05667 1/2001 (WO) .

OTHER PUBLICATIONS

International Search Report date Jun. 1, 2001.

* cited by examiner

*Primary Examiner*—Gary E. Elkins
(74) *Attorney, Agent, or Firm*—Gerard J. McGowan, Jr.

(57) ABSTRACT

A new liner which includes one or more medial panels and two end panels, one on each end. Preferably there are at least three medial panels. The length of the end panels are each no more than 50% the length of any of the medial panels. The invention also pertains to a carton or shipping case including the liner.

22 Claims, 3 Drawing Sheets

LINER AND CARTON

BACKGROUND OF THE INVENTION

Owing in part to the popularity of the so-called "club" stores, there is perceived to be an Increase In consumer demand for products packaged in larger unit volumes. The demand for larger units has resulted in a need for suitable packaging for such units. Among the problems with which the packaging engineer must deal in devising suitable containers, is the increased weight which such containers must be capable of holding.

Increases in unit volume impact not only the immediate container for the product, but also secondary and tertiary packaging. For instance, cartons in which the larger/heavier containers are shipped must also be suitable and may have to be adapted to the new containers.

The Procter and Gamble Company uses a display carton for its 96 Load Tide® detergent product. The display carton includes four triangular corner posts and front and rear display windows wherein a portion of carton has been bent over and adhered to itself.

Ellison et al., U.S. Pat. No. 3,891,137 discloses a fiberboard container constructed from an outer blank of corrugated fiber board and a separate and distinct inner liner of corrugated fiberboard which is laminated interior thereof. A generally rectangular access door is located in one of the sidewall panels and is hinged to the remainder of the outer blank along an edge. An object of the Ellison et al. invention is said to be to provide a reinforced bulk container with an access door which does not substantially weaken the container. The cuts forming the access door in Ellison et al. are positioned at least two inches from the corners so as not to diminish the stacking strength. The width of access door 48 in FIGS. 3 and 4 of Ellison et al. may vary up to amount equal to the width of sidewall panel 32.

Vesborg, U.S. Pat. No. 4,382,504 is directed to a transport and display container.

Spamer, U.S. Pat. No. 5,039,002 is directed to a case for displaying articles in retail outlets, which is preferably formed of corrugated plastic or paperboard material.

DeMott, U.S. Pat. No. 5,277,360 is directed to a stackable container having a display opening. Locking slots and locking tabs are illustrated.

Edgerton et al., U.S. Pat. No. 5,372,299 is directed to a combined product shipping and display box.

Leftwich et al., U.S. Pat. No. 5,657,872 is directed to shipping/display container which includes a tray portion having a bottom panel, two opposed end panels and two opposed side panels. A front side panel includes a line of weakness defining a severable portion in at least an intermediate portion downward to the lower-most edge of the front side panel. The severable portion includes a preformed aperture located adjacent to the lower-most edge of the front panel for initiating removal of the severable region. It is said that because the severable portion, at least in its center region, is preferably completely removed down to the bottom panel, products may be extracted from the resulting opening even though other containers or articles may be stacked both above and below the subject container limiting the ability to extract packages at an angle.

Carr et al., U.S. Pat. No. 5,718,337 discloses a carton for a bag stack. The carton includes two unshaped upper edges defining access windows. The front and back walls are provided with a hinged or removable panel below the access window to allow the sizes of the front and back windows to be increased.

SUMMARY OF THE INVENTION

The present invention is directed in one aspect to a shipping case which is suitable for shipping consumer and other goods, including goods which are packaged in high unit volume. The invention can also be used as a carton for primary packaging. The case or carton of the invention can be expected to enjoy excellent compressive strength, e.g., so that the cases or cartons may be stacked one upon the other notwithstanding the substantial weight of the high unit volume consumer products, e.g. 300 fluid oz. heavy duty liquid detergent containers.

In a preferred embodiment, the case or carton comprises four panels, a front panel, an opposed rear panel, and two opposed side panels between the front and rear panels. Bottom and top closures preferably comprise two major flaps and two minor flaps. The case or carton includes a liner having liner walls adjacent the panels of the case. Preferably the liner includes at least two liner walls, more preferably at least three liner walls and most preferably includes three liner walls and two partial liner walls (and walls), the partial liner walls cot responding substantially in height to the height of the front panel yet comprising only a fraction of the width.

In accordance with another advantageous feature of the invention, one or more of the walls of the liner include extensions, such as tabs, which are received within one or more apertures, such as slots, in the bottom closure. These serve to help secure the liner in the case or carton. In addition, it is preferred that the sections of fiberboard in which the extensions of the liners are formed also be used to from liners. Such "nesting" saves paperboard and helps decrease the cost of the liner. Where such nesting is used, the top of the liner will include a cutout corresponding roughly to the shape of the extension.

In another aspect, the invention relates to a new liner which includes one or more medial panels and two end panels, one on each end. Preferably there are at least three medial panels. The length of the end panels are each no more than 50% the length of any of the medial panels. The invention also pertains to a carton or shipping case including the liner.

For a more complete understanding of the above and other features and advantages of the invention, reference should be made to the following detailed description of the preferred embodiments and the accompanying drawings.

DETAILED DESCRIPTION OF THE INVENTION

Figure 1:
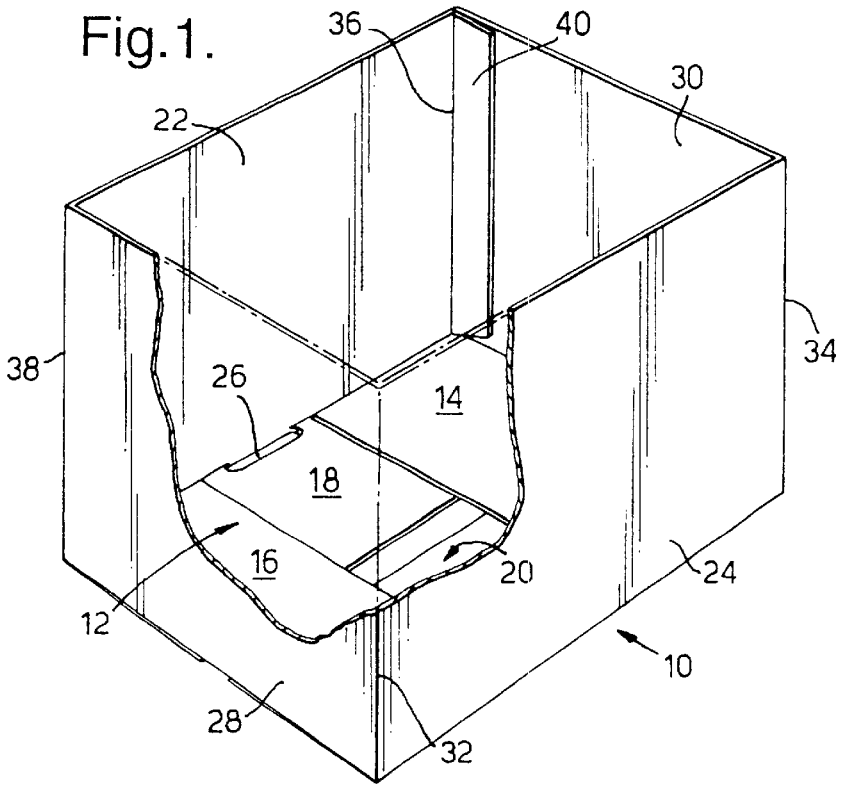
FIG. 1 is a perspective view of a case according to the invention with the top and a portion of the front panel removed to permit viewing of the interior.

Case 10 (FIG. 1) comprises bottom closure 12 which includes minor flaps 14 and 16 and underlying major flaps 18 and 20.

Extending upwardly from major closure flaps 18 and 20, respectively, are first and second side panels 22 and 24. Medial to the intersections of bottom closure panels 18, 20 with side panel 22, 24 are disposed slots 26, 28. Extending upwardly from minor flaps 16 and 14 are, respectively, front panel 28 and rear panel 30. A portion of panel 28 is removed to show the interior, although it is preferred that the front, side and rear panels are fully intact (no portions removed) in the present invention. Panels 22, 28, 24 and 30 are separated from each other respectively by fold lines 38, 32, and 34, respectively. Separated from first side panel 22 by scoreline 36 is glue flap 40.

Figure 4:
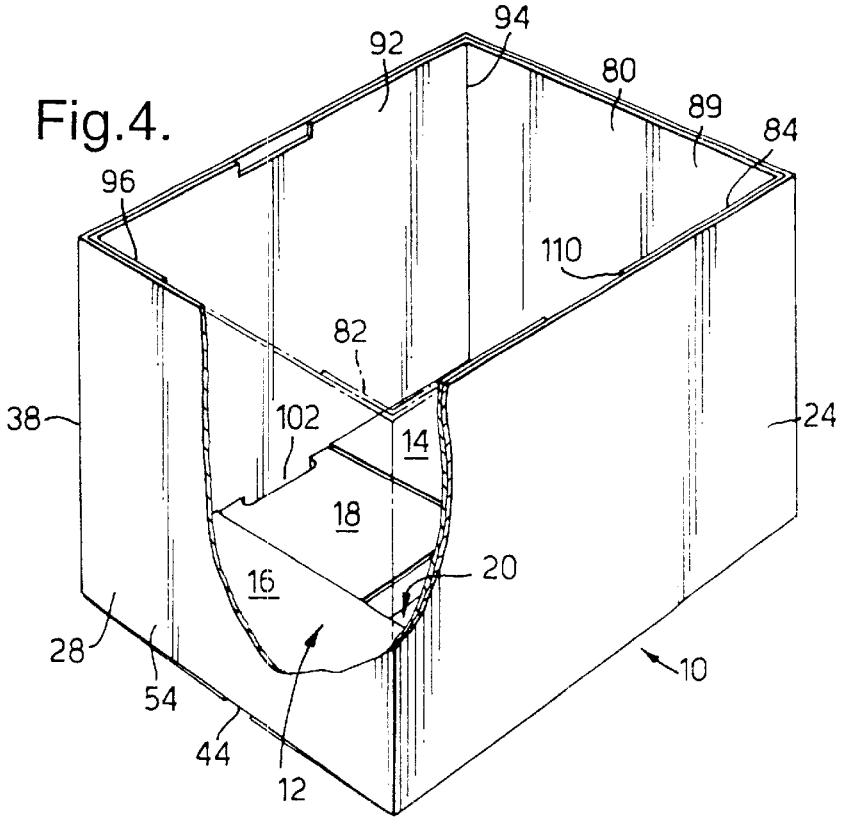
FIG. 4 is a perspective view showing an erected shipping case according to the invention similar to FIG. 1, except that the liner has also been inserted.
Figure 2:
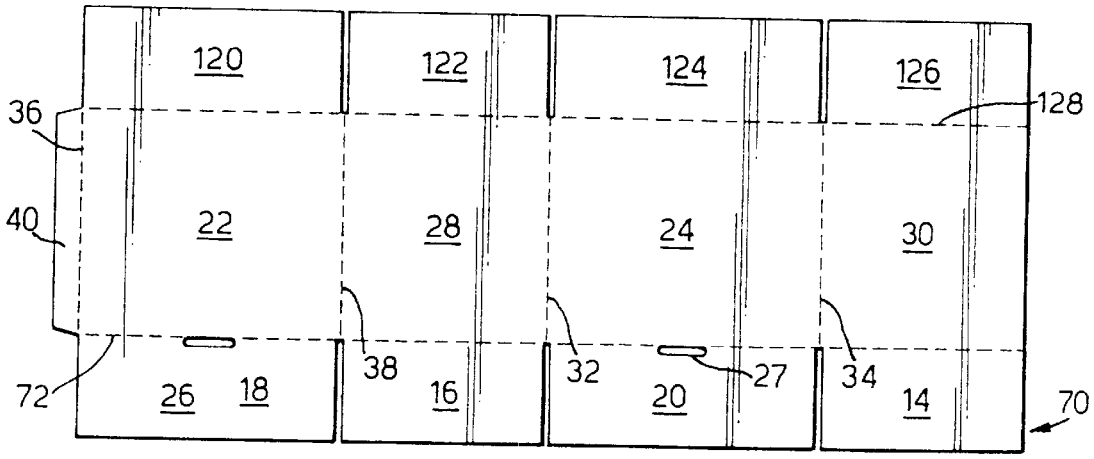
FIG. 2 is a top plan view of a case blank which may be used to make the case of the invention, showing the side of the blank which will form the outside of the case.
Figure 3:
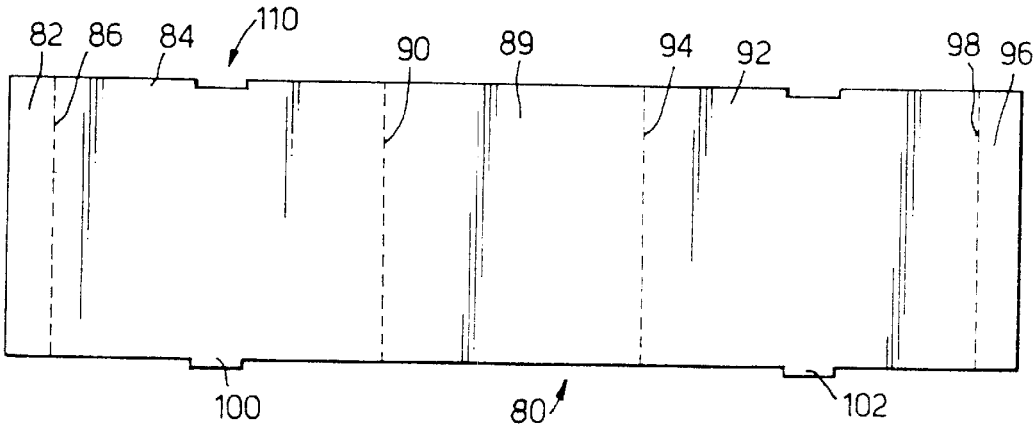
FIG. 3 is top plan view of a liner of the invention, showing the side of liner which will constitute the outside of the liner.
Figure 5:
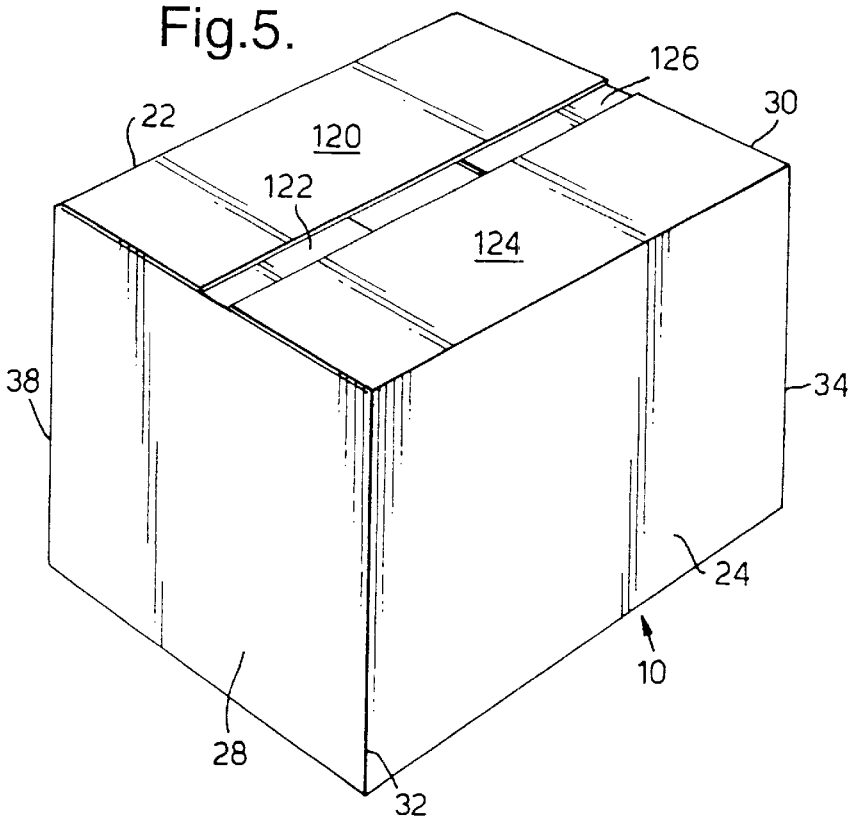
FIG. 5 is a perspective view of an assembled shipping case according to the invention.

Top closure panels 120, 124 extend from panels 22, 24 respectively and top closure flaps 122, 126 extend respectively from panels 28, 30 (FIGS. 2 and 5). The top closure panel and flaps are removed from FIGS. 1 and 4 to facilitate viewing of the invention.

As seen particularly in FIG. 2, blank 70 can be used to form display case 10. In addition to the features already described, blank 70 includes scoreline 72 which separates respectively panel 22 from flap 18, panel 28 from flap 16, panel 24 from flap 20 and panel 30 from flap 14. Likewise, scoreline 128 separates panel 22 from panel 120, panel 28 from flap 122, panel 24 from panel 124 and panel 30 from flap 126.

As seen particularly in FIG. 4, case 10 may be lined with C-liner 80. Liner 80 includes end wall 82 which corresponds substantially in height to panel 28. Wall 82 is separated from liner sidewall 84 by fold line 86. Liner medial wall 84 corresponds substantially in dimension to second side panel 24. Rear medial wall 89 is separated from liner sidewall 84 by fold line 90. Wall 89 corresponds substantially in dimension to rear panel 30. Liner medial sidewall 92 is separated by scoreline 94 from liner wall 89. Liner wall 92 corresponds substantially in dimension to the side panel 22 of case 10. Liner end wall 96 is separated from liner wall 92 by fold line 98. Liner wall 96 corresponds substantially in height to that of panel 28. Together, walls 96 and 82 occupy substantially less than the full width of panel 28, so material is conserved.

Preferably, each of the end walls is at least 50% less in length, especially at least 60% less, more preferably at least 80% less than the length of any of the medial walls.

Each of liner sidewalls 84 and 92 include an extension at the bottom thereof in the form of a tab, 100, 102 respectively. The tabs are adapted to be inserted into slots 26, 27 of flaps 18, 20 in order better to secure the liner within the case. The tabs are borrowed from what will become an adjacent liner blank during cutting of the blank. For instance, tab 100 would be borrowed from a blank adjacent blank 80 on the side of tab 100. This would result in a cutout such as cutout 110. Cutout 110 would result from the formation of a tab in a blank formed adjacent blank 80 on the side of cutout 110.

The carton and liner are preferably made of fiberboard, although other materials may be suitable. For instance, a plastic liner may be employed in certain situations. It will be understood that where fold lines are described, any lines promoting folding of the fiberboard along the line, such as scorelines may be employed. When lines of weakness are described, lines which facilitate the tearing along those lines of the material by a human with a reasonable amount of effort, such as partially cut scorelines and perforated lines, are employed.

The case blank 70 is formed into case 10 by squaring the various panels and adhering glue panel 40 to rear panel 30 with chemical adhesive, hot melt or other suitable adhesive. The major closure flaps 18, 20, 120, 124 may, if desired, be adhered to the minor closure flaps 16, 14, 122, 126 with chemical adhesive, hot melt or the like. Generally the top closure flaps will be sealed after the liner and the product have been inserted.

Liner 80 is likewise squared and then inserted into erected case 10. Tabs 100, 102 will be received within slots 26, 27 to assist in keeping liner 80 snuggly within carton 10. Liner 80 is particularly useful where case 10 is to be used to transport and/or display consumer products which have a high weight per unit, such as 300 oz. liquid detergent or liquid fabric softener containers. Use of the liner ensures that the case possess as much warehouse stacking strength as would be required. The filled cases may readily be stacked one upon the other.

A further advantage of the present design is that it is not necessary to reinforce the corners of the case or carton with special triangular structures. Moreover, the present case or carton, apart from the liner, is made from a single piece blank.

The slots and tab arrangements of the present invention tend to prevent "towing in" of the liner and so therefore promote the integrity of the lined case. The slots are preferably rounded, as illustrated, since this results in better stripping of the fiberboard during slot formation. Preferably the tabs 102, 100 are dimensioned so as to rest firmly on the surface which supports the bottom of the case.

Figure 6:
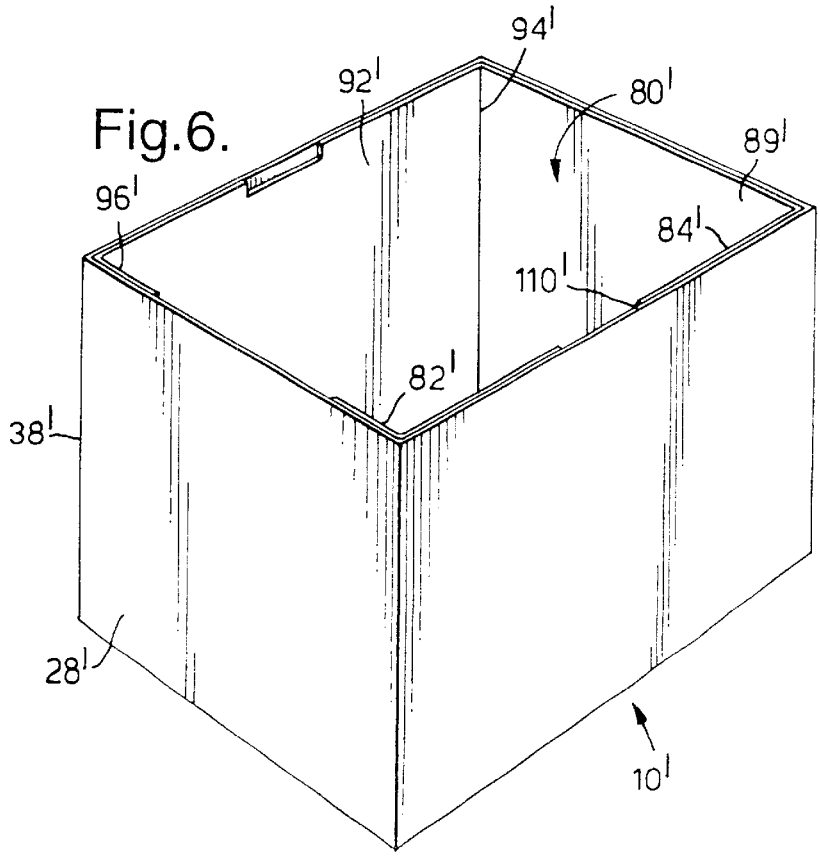
FIG. 6 is a perspective view of an alternate embodiment wherein the case does not include top closure flaps.

The invention may be utilized with a regular slotted case, as illustrated, although it may also be used in a half slotted container, that is one without upper closure flaps, such as container 10' in FIG. 6 (corresponding features shown with primed reference numbers).

In accordance with the preferred design, the case or carton comprises four panels, for compressive strength, rather than having flaps supporting the sides of the package. However, other arrangements wherein the package is not supported panels on four (4) side may be used.

It is preferred that additional support items, such as additional dividers or liner be excluded from the cases of the invention.

Cartons are solid fiberboard or corrugated primary packages which directly contain product. They generally have greatly diminished compressive strength, exclusive of liners and dividers, under 300 lbs. vertical top load force using test ASTM D642. Shipping cases exclusive of lines and dividers, on the other hand, have much higher compressive strengths usually on the under of 500 lb. or greater under ASTM D642.

The present invention may be used with either shipping cases or cartons although it will be most beneficial in enhancing the compressive strength needed for shipping cases.

It should be understood of course that the specific forms of the invention herein illustrated and described are intended to be representative only as certain changes may be made therein without departing from the clear teachings of the disclosure. Accordingly, reference should be made to the following appended claims in determining the full scope of the invention.

What is claimed is:

1. A shipping case or carton comprising a front panel, first and second side panels on opposite sides of the front panel, a rear panel between the first and second side panels and opposite the front panel, bottom closure flaps and a liner comprising at least three medial walls, each of which has dimensions substantially corresponding to one of the panels, the liner further including on each end an end wall, each end wall having substantially the same height as the medial walls, each end wall being less than 50% the length of any of the medial walls, wherein said liner includes at least one extension and said bottom closure includes at least one aperture adapted to receive said extension.

2. The shipping case or carton according to claim 1 wherein said end walls are each at least 60% less than the length of any of the medial walls.

3. The shipping case or carton according to claim 2 wherein said end walls are each at least 80% less than the length of any of the medial walls.

4. The case or carton according to claim 1 wherein said bottom closure includes one or more apertures.

5. The case or carton according to claim 1 wherein said extension is a first tab and said aperture is a first slot.

6. The case or carton according to claim 5 wherein said first tab extends from said first side panel and a second tab extends from said second side panel, said bottom closure including said first slot receiving said first tab and said bottom closure further comprising a second slot receiving said second tab.

7. The case or carton according to claim 6 wherein said extension extends from a liner wall and said liner wall further includes a cut out of dimensions corresponding to the extension.

8. The shipping case or carton according to claim 1 wherein said case further includes top closure flaps.

9. The shipping case or carton according to claim 1 wherein said case does not include top closure flaps.

10. The shipping case according to claim 1.

11. A shipping case or carton comprising an outer front wall, first and second side outer walls on opposite sides of the front outer wall, a rear outer wall between the first and second side outer walls and opposite the front outer wall, a bottom closure wall and a liner comprising at least three medial walls, each of which has dimensions substantially corresponding to one of the outer walls, the liner further including on each end an end wall, each end wall having substantially the same height as the medial walls, each end wall being less than 50% the length of any of the medial walls, wherein said liner includes at least one extension and said bottom closure includes at least one aperture adapted to receive said extension.

12. The shipping case or carton according to claim 11 wherein at least one of said outer walls is formed from a plurality of flaps.

13. The shipping case or carton according to claim 11 wherein at least two of said outer walls is formed from a plurality of flaps.

14. The shipping case according to claim 11.

15. A liner having one or more medial panels and two end panels and having a bottom, one at each end of the liner, each end panel being no more than 50% of the length of any of the medial panels, said liner including at least one bottom extension.

16. The liner according to claim 15 wherein the end panels are of essentially the same length.

17. The liner according to claim 15 wherein the end panel and the medial panels are of essentially the same height.

18. The liner according to claim 13 wherein said end walls are each at least 60% less than the length of any of the medial walls.

19. The liner according to claim 13 wherein said end walls are each at least 80% less than the length of any of the medial walls.

20. The liner according to claim 15 wherein there are at least three medial panels.

21. The liner according to claim 18 wherein there are exactly three medial panels.

22. The liner according to claim 15 wherein the panels are separated from each other by scorelines.

* * * * *